United States Patent [19]

Nakajima et al.

[11] Patent Number: 4,801,251

[45] Date of Patent: Jan. 31, 1989

[54] SLIDING-VANE ROTARY COMPRESSOR

[75] Inventors: Nobuyuki Nakajima; Kenichi Inomata; Shigeru Okada, all of Konan, Japan

[73] Assignee: Diesel Kiki Co., Ltd., Tokyo, Japan

[21] Appl. No.: 100,344

[22] Filed: Sep. 23, 1987

[30] Foreign Application Priority Data

Oct. 9, 1986 [JP] Japan ..... 61-241019

[51] Int. Cl.[4] ..... F04C 29/08; F04B 49/02

[52] U.S. Cl. ..... 417/295; 417/310; 417/270

[58] Field of Search ..... 417/295, 310; 418/270

[56] References Cited

U.S. PATENT DOCUMENTS

| | | | |
|---|---|---|---|
| 3,205,831 | 9/1965 | Burns | 91/482 |
| 4,060,343 | 11/1977 | Newton | 417/309 |
| 4,515,513 | 5/1985 | Hayase | 418/270 |
| 4,557,670 | 12/1985 | Inagari | 417/310 |
| 4,668,172 | 5/1987 | Shibuya | 418/270 |
| 4,726,740 | 2/1988 | Suzuki et al. | 417/295 |

FOREIGN PATENT DOCUMENTS

| | | | |
|---|---|---|---|
| 174516 | 3/1986 | European Pat. Off. | 417/295 |
| 3623825 | 1/1987 | Fed. Rep. of Germany | 417/295 |
| 3629199 | 3/1987 | Fed. Rep. of Germany | 417/310 |

*Primary Examiner*—William L. Freeh

*Attorney, Agent, or Firm*—Wenderoth, Lind & Ponack

[57] ABSTRACT

A sliding-vane rotary compressor includes a recess defined in a cylinder and to which a discharge hole is open, a cover secured to the cylinder to close the recess, a discharge valve disposed in a valve receiving chamber defined between the cover and the cylinder, and a discharge connecting hole extending in the cylinder and a side block for connecting the interior space of the recess and a high pressure chamber. The compressor thus constructed is simple in size and light in weight due to non-inclusion of a shell which is required in the conventional compressor. Preferably, a displacement adjustment mechanism is incorporated in the compressor for adjusting the displacement of the latter.

2 Claims, 7 Drawing Sheets

SLIDING-VANE ROTARY COMPRESSOR

FIELD OF THE INVENTION

The present invention relates to a sliding-vane rotary compressor suitable for use in an automotive air conditioning system.

RELATED ART

There are known two types of sliding-vane rotary compressors: one has dual operating compartments as disclosed, for example, in Japanese Patent Laid-open Publication No. 60-204992, and the other has an eccentric rotor as shown, for example, in Japanese Patent Laid-open Publication No. 61-89993.

The dual compartment type compressor, as shown here in FIG. 10 of the accompanying drawings, includes a cylinder 1 having a substantially elliptical bore in which a rotor 2 is rotatably disposed. The rotor 2 is slidingly engageable with the inner wall of the cylinder 1 along a minor axis of the elliptical bore so as to define therebetween two operating compartments 3*a*, 3*b* disposed in symmetric relation to one another. The rotor 2 carries thereon a plurality (five being shown) of radially movable vanes 6*a*–6*e* slidably engageable with the inner wall of the cylinder 1. The cylinder 1, the rotor 2 and the vanes 6*a*–6*e* define therebetween compression chambers 8*a*–8*e* which varies in volume with each revolution of the rotor 2. The cylinder 1 has two discharge holes 22*a*, 22*d* which are opened and closed by corresponding discharge valves 29*a*, 29*b*. The cylinder 1 is surrounded by a shell 47 with a space leaving therebetween for the passage of a discharge gas.

The eccentric rotor type compressor, as shown in FIG. 11, includes a cylinder 1 having a circular bore in which a circular rotor 2 is disposed in eccentric relation to the bore with a part of its peripheral surface held in sliding contact with a portion of the inner wall of the cylinder 1 so as to define therebetween a single operating compartment 3. The rotor 2 supports thereon a pair of substantially radially movable vanes 6*a*, 6*b* slidably engageable with the inner wall of the cylinder 1. The cylinder 1, the rotor 2, and the vanes 6*a*, 6*b* jointly define therebetween two compression chambers 8*a*, 8*b* which vary in volume with each revolution of the rotor 2. The cylinder 1 has at least one discharge hole 22 and a discharge valve 29 for opening and closing the discharge hole 22. Unlike the dual compartment type compressor wherein the cylinder 1 is disposed in the shell for defining therebetween a discharge gas passage, the eccentric rotor type compressor includes a cover 25 attached to the cylinder 1 to cover the discharge valve 29 with a channel leaving between the cover 25 and the cylinder 1 for the passage of the discharge gas.

The dual compartment type compressor is advantageous in that the discharge gas passage can be sealed reliably with utmost ease by means of the shell 47 extending around the cylinder 1. The compressor having such shell 47 is however large in size and heavy in weight. On the other hand, the eccentric rotor type compressor is compact in size and light in weight because the cover 25 extends only in the vicinity of the discharge valve. The compressor having such cover 25 is however defective in sealing as described below in greater detail.

As shown in FIG. 12, the arcuate or dome-like cover 25 is disposed on the cylinder 1 in such a manner to connect the vicinity of the discharge valve 29 in fluid communication with a discharge connecting hole 30 extending through a radial extension of a side block 11 secured to a rear end of the cylinder 1. A pair of O-rings 48*a*, 48*b* are disposed around the discharge valve 29 and the discharge connecting hole 30, respectively, to provide two seal surfaces extending perpendicular to one another. The cover 25 is secured to the cylinder 1 by four screws 26*a*–26*d* and also to the side block 11 by two screws 49*a*, 49*b*. With this arrangement, the O-ring 48*a* is elastically deformed to lie flatwise over the cylinder 1 as the screws 26*a*–26*d* are tightened. On the other hand, the O-ring 48*b* is elastically deformed when the screws 49*a*, 49*b* are tightened. Since the two O-rings 48*a*, 48*b* extend perpendicularly to one another, the cover 25 is likely to be displaced away from the cylinder 1 when the screws 49*a*, 49*b* are tightened first. With this displacement of the cover 25, only an insufficient compression of the O-ring 48*a* and hence an insufficient seal is obtained even when the screws 26*a*–26*d* are tightened thereafter. To avoid this difficulty, tightening of the screws 26*a*–26*d* must be done first while continuously urging the cover 25 toward the side block 11. Such assembling operation is however tedious and time-consuming and seals thus provided are still unsatisfactory.

SUMMARY OF THE INVENTION

It is therefore an object of the present invention to provide a sliding-vane rotary compressor which is compact in size and light in weight due to non-inclusion of a shell.

Another object of the present invention is to provide a sliding-vane rotary compressor having a hermetically sealed discharge valve portion.

A further object of the present invention is to provide a sliding-vane rotary compressor having a discharge part which can be assembled easily and less costly.

A still further object of the present invention is to provide a sliding-vane rotary compressor incorporating structural features which enable an adjustable control of the displacement of the compressor according to operating conditions.

According to a first aspect of the present invention, there is provided a sliding-vane rotary compressor comprising:

a cylinder and a rotor rotatably disposed in said cylinder so as to define therebetween an operating compartment, the rotor carrying thereon a plurality of approximately radially movable sliding vanes, there being defined between the cylinder, the rotor and the vanes a plurality of compression chambers which vary in volume with each revolution of the rotor;

a pair of side blocks secured to opposite ends of the cylinder;

a pair of heads secured to the side blocks, respectively, on opposite sides of the cylinder;

one of the side block and one of the heads secured to the one side block jointly defining therebetween a low pressure chamber extending in fluid communication with an intake port of the compressor;

the other side block and the other head jointly defining therebetween a high pressure chamber extending in fluid communication with a discharge port of the compressor;

the one side block having an intake hole connecting the low pressure chamber and the operating compartment;

the cylinder having a recess defined in an outer surface thereof, and a discharge hole having one end opening to the operating compartment and the other end opening to said recess;

a cover secured to the cylinder and extending over the recess to close the latter, there being defined between the cylinder and the cover a valve receiving chamber;

a discharge valve disposed in the valve receiving chamber for opening and closing the discharge hole; and the cylinder and the other side block having a discharge connecting hole extending between the recess and the high pressure chamber.

As described above, the discharge connecting hole for connecting the interior space of the recess and the high pressure chamber extends in the cylinder and said other side block with the result that a seal between the cover and the side block is no longer necessary.

According to a second aspect of the present invention, there is provided a sliding-vane rotary compressor comprising:

a cylinder and a rotor rotatably disposed in said cylinder so as to define therebetween an operating compartment, the rotor carrying thereon a plurality of approximately radially movable sliding vanes, there being defined between the cylinder, the rotor and the vanes a plurality of compression chambers which vary in volume with each revolution of the rotor;

a pair of side blocks secured to opposite ends of the cylinder;

a pair of heads secured to the side blocks, respectively, on opposite sides of the cylinder;

one of the side block and one of the heads secured to the one side block jointly defining therebetween a low pressure chamber extending in fluid communication with an intake port of the compressor;

the other side block and the other head jointly defining therebetween a high pressure chamber extending in fluid communication with a discharge port of the compressor;

the one side block having an intake hole connecting the low pressure chamber and the operating compartment;

the cylinder having a recess defined in an outer surface thereof, and a discharge hole having one end opening to the operating compartment and the other end opening to said recess;

a cover secured to the cylinder and extending over the recess to close the latter, there being defined between the cylinder and the cover a valve receiving chamber;

a discharge valve disposed in the valve receiving chamber for opening and closing the discharge hole;

the cylinder and the other side block having a discharge connecting hole extending between the recess and the high pressure chamber; and a displacement-adjustment mechanism incorporated in the one side block and the one head for adjusting displacement of the compressor.

With this construction, a shell as required in the conventional compressor is no longer necessary and hence the compressor of this invention is compact in size and light in weight and is capable of adjusting the displacement thereof.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
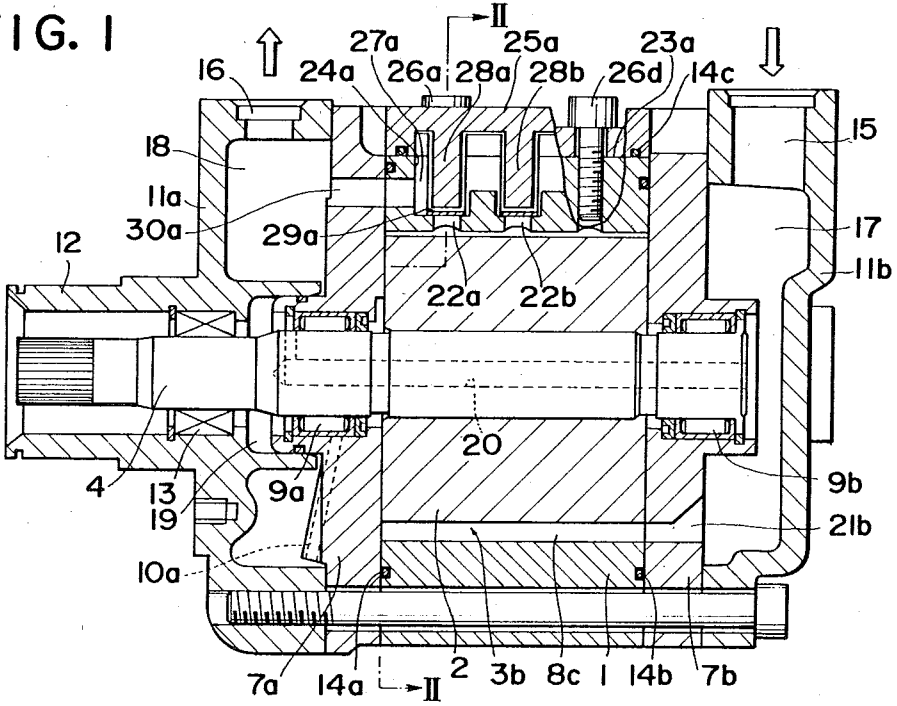
FIG. 1 is a longitudinal cross-sectional view taken along line I—I of FIG. 2, showing a sliding-vane rotary compressor according to a first embodiment of the present invention.
Figure 2:
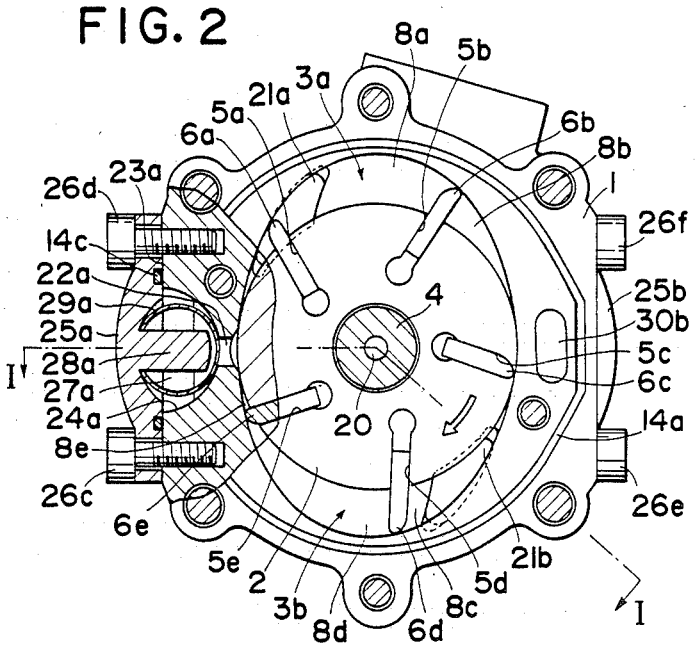
FIG. 2 is a cross-sectional view taken along line II—II of FIG. 1.
Figure 3:
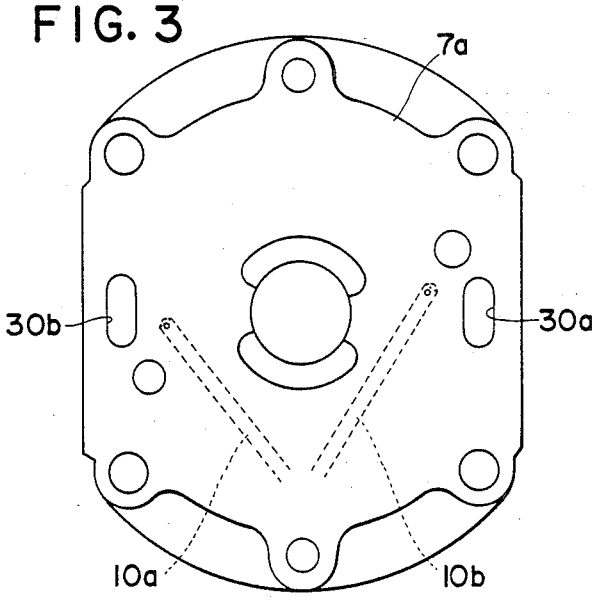
FIG. 3 is a side view of a first side block of the compressor.
Figure 4:
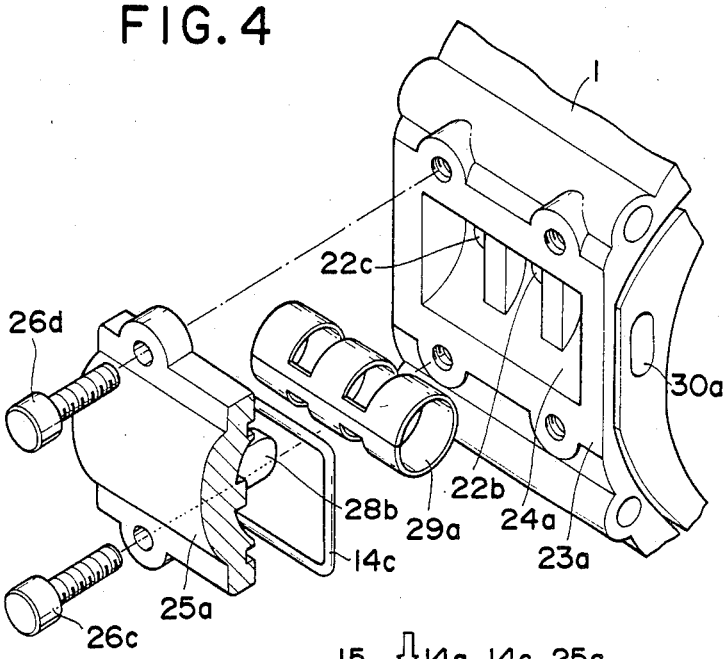
FIG. 4 is an exploded perspective view, showing a discharge valve and its related parts of the compressor.

As shown in FIGS. 1 through 4, a sliding-vane rotary compressor embodying the present invention includes a cylinder 1 and a rotor 2 rotatably disposed in a substantially elliptical bore in the cylinder 1. The rotor 2 is sealingly engageable with the inner wall of the cylinder 1 along a minor axis of the elliptical bore so that the there are defined between the rotor 2 and the cylinder 1 two operating compartments 3*a*, 3*b* disposed in symmetric relation to one another. The rotor 2 is fixedly mounted on a drive shaft 4 in concentric relation thereto and includes a plurality (five in the illustrated embodiment) of approximately radial slots 5*a*–5*e* in which vanes 6*a*–6*e* are slidably inserted, respectively.

A pair of front and rear side blocks 7*a*, 7*b* is secured to opposite ends of the cylinder 1 and held in sliding contact with the rotor 2 and the vanes 6*a*–6*e*. Thus, there are five compression chambers 8*a*–8*e* defined between the cylinder 1, the rotor 2, the vanes 6*a*–6*e* and the side blocks 7*a*, 7*b*. The drive shaft 4 is rotatably supported by the side blocks 7*a*, 7*b* via a pair of radial bearings 9*a*, 9*b*. The front side block 7*a* has a pair of internal lubricant supply grooves 10*a*, 10*b* extending in a V-shaped fashion for the passage therethrough of a lubricating oil flowing from a lower portion of a front head (described later) to the interface between the rotor 2 and the front side block 7*a* and also to the back of each vane 6*a*–6*e*.

A pair of generally cup-shaped front and rear heads 11*a*, 11*b* is secured to the front and rear side blocks 7*a*, 7*b*, respectively, on opposite sides of the cylinder 1. The front head 11*a* includes a hollow cylindrical hub 12 projecting axially outwardly away from the front side block 7*a* for receiving therein an electromagnetic clutch (not shown). The drive shaft 4 has an end portion extending longitudinally in the hub 12 for being releasably coupled with an engine crankshaft (not shown) via the clutch to receive the engine torque. A mechanical seal 13 is disposed between the end portion of the drive shaft 4 and the front head 11*a*.

The cylinder 1, the side blocks 7*a*, 7*b* and the heads 11*a*, 11*b* have respective flat confronting end surfaces engageable flatwise with each other to provide a hermetic seal with or without a separate sealing means disposed therebetween. In the illustrated embodiment, a pair of first and second O-rings 14*a*, 14*b* is interposed respectively between the front side block 7*a* and the cylinder 1 and between the cylinder 1 and the rear side block 7*b*. The rear head 11*b* has defined therein an intake port 15 and the front head 11*a* has defined therein a discharge port 16. The intake port 15 is connected in fluid communication with a low pressure chamber 17 defined between the rear side block 7*b* and the rear head 11*b*. The discharge port 16 is connected in fluid communication with a high pressure chamber 18 defined between the front side block 7*a* and the front head 11*a*. The front side block 7*a* and the front head 11*a* also define therebetween a low pressure guide chamber 19 opening toward the mechanical seal 13. The low pressure guide chamber 19 is held in fluid communication with the low pressure chamber 17 through a low pressure guide groove 20 extending in the drive shaft 4. With this arrangement, a low pressure introduced in the low pressure guide chamber 19 lowers the loads on the mechanical seal 13, thereby enabling the mechanical seal 13 to operate reliably for a prolonged period of time.

The rear side block 7*b* has a pair of intake holes 21*a*, 21*b* defined therein in symmetric relation and connecting the low pressure chamber 17 with the operating compartments 3*a*, 3*b*. With the intake holes 21*a*, 21*b* thus arranged, the low pressure chamber 17 is brought into fluid communication with the compression chambers 8*a*–8*e* when the respective compression chambers 8*a*–8*e* increase in volume. The cylinder 1 has two sets (only one set being shown) of discharge holes 22*a*–22*c* extending radially across the peripheral wall of the cylinder 1. The discharge holes 22*a*–22*c* have their one ends opening to the operating compartments 3*a*, 3*b* at diametrically opposite portions of the inner wall of the cylinder 1 which extend along the minor axis of the elliptical bore. The outer peripheral surface of the cylinder 1 is flatted at two diametrically opposite portions thereof for the attachment of a pair of arcuate covers 25*a*, 25*b*. Each of the flatted cover attachment portions 23*a* (only one shown) includes a recess 24*a* having three laterally spaced arcuate grooves to which the other ends of the respective discharge holes 22*a*–22*c* are open.

Each of the covers 25*a*, 26*b* is secured to the cover attachment portion 23*a* by means of four screws 26*a*, 26*c*, 26*d*; 26*e*, 26*f* (five being shown) threading through the cover 25*a*, 25*b* into the cylinder 1. Disposed between the covers 25*a*, 25*b* and the cover attachment portion 23*a* is a third O-ring 14*c* extending around the recess 24*a* to provide a hermetic seal. The covers 25*a*, 25*b* has a recessed arcuate inner wall so that there is defined between the covers 25*a*, 25*b* and the recess 24*a* in the cylinder a valve-receiving chamber 27*a*. The cover 25*a*, 25*b* also includes three (only two being shown) laterally spaced stopper projections 28*a*, 28*b* extending toward the cylinder 1 in alignment with the respective discharge holes 22*a*—22*e*.

The valve-receiving chambers 27*a* receive respectively therein a pair of discharge valves 29*a* (only one shown). Each of the discharge valve 29*a* is formed from a sheet of resilient material into a split tube having a longitudinal slit. The tubular discharge valve 29*a* is spread against its own resiliency when it is retained on the stopper projections 28*a*–28*e* of the cover 25*a*, 25*b*. The discharge valve 29*a* thus attached has outer peripheral portions normally held in contact with the bottom wall of the recess 24*a* to close the open ends of the respective discharge holes 22*a*–22*c*.

The high pressure chamber 18 and the valve-receiving chambers 27*a* are held in fluid communication with each other by means of a pair of discharge connecting holes 30*a*, 30*b* extending through the cylinder 1 and the front side block 7*a*. The discharge connecting holes 30*a*, 30*b* are disposed radially inwardly of the first O-ring 14*a* so that they are held gas-tight by means of the O-ring 14*a*.

With this construction, when the drive shaft 4 is driven to rotate the rotor 2 in one direction, the vanes 6*a*–6*e* slide along the inner wall of the cylinder 1 to cause the compression chambers 8*a*–8*e* to successively increase and decrease in size with each revolution of the rotor 2. As the compression chambers 8*a*–8*e* increase in size or volume, they are brought to fluid communication with the low pressure chamber 17 through the intake holes 21*a*, 21*b*, whereupon a gas which has been introduced from the intake port 15 into the low pressure chamber 17 is drawn into the compression chambers 8*a*–8*e* through the intake holes 21*a*, 21*b*. Then the compression chambers 8*a*–8*e* gradually decrease in size and when succeeding vanes 6*a*–6*e* move past the intake holes 21*a*, 21*b*, the gas is trapped in the compression chambers 8*a*–8*e*. Thus, the compression is commenced. A further movement of the rotor 2 causes the preceding vanes 6*a*–6*e* to move past the discharge holes 22*a*–22*c* whereupon the compression chambers 8*a*–8*e* communicate with the discharge holes 22*a*–22*c* and then the discharge valves 29*a* are forced by the pressure in the compression chambers 8*a*–8*e* to retract away from the discharge holes 21*a*–21*c* until the valves 29*a* engage the stopper projections 28*a*–28*c* of the covers 25*a*, 25*b*. Consequently, the gas is discharged from the compression chambers 8*a*–8*e* through the discharge holes 22*a*–22*c* into the valve-receiving chambers 27*a*. Then the gas flows through the discharge connecting holes 30 into the high pressure chamber 18, and finally is discharged from the discharge port 16 to the outside of the compressor.

Figure 5:
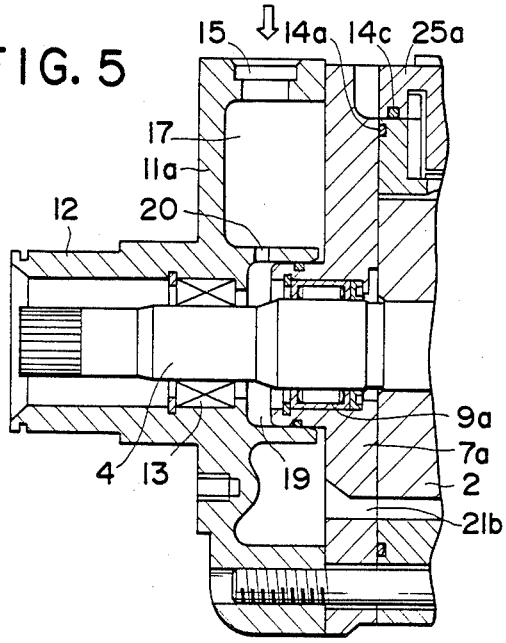
FIG. 5 is a longitudinal cross-sectional view showing a part of a compressor according to a second embodiment.
Figure 6:
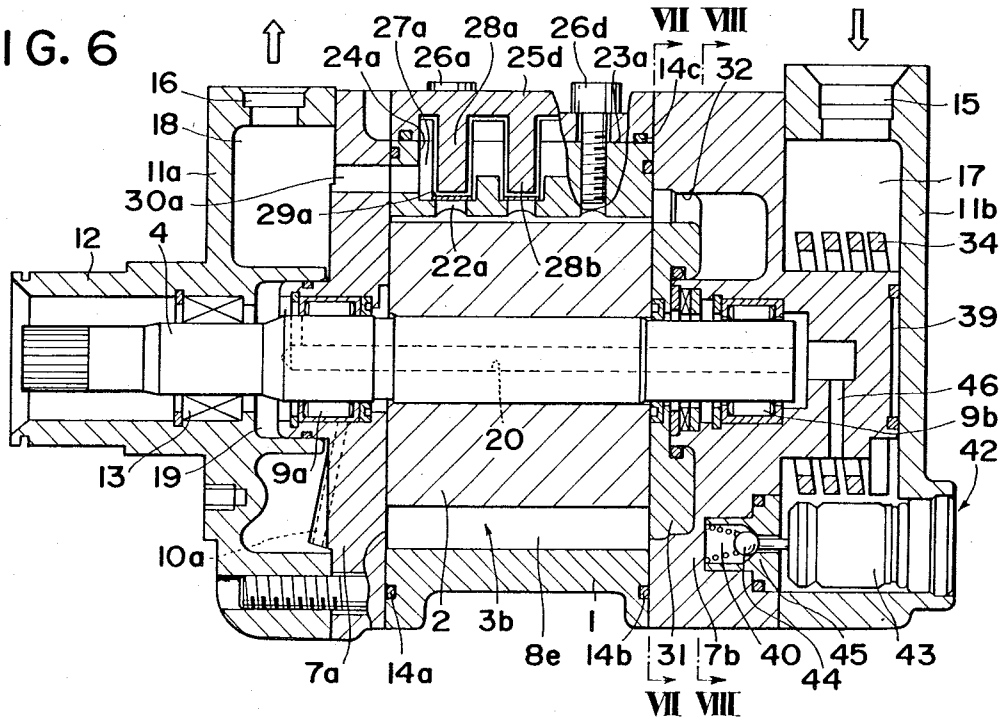
FIG. 6 is a longitudinal cross-sectional view of a sliding-vane rotary compressor according to a third embodiment.

A second embodiment shown in FIG. 5 differs from the foregoing embodiment in that the compressor has an intake side at its front end and a discharge side at its rear end. The compressor includes a front side block 7*a* which is replaceable with the rear side block 7*b* of the foregoing embodiment. The front side block 7*a* includes a pair of intake holes 21*a* (only one shown) while a non-illustrated rear block is provided with discharge holes. A front head 11*a* of the compressor has an intake port 15 which is corresponding to the discharge port 16 of the compressor of the foregoing embodiment. Other structural details of the compressor are the same as those of the foregoing embodiment with the exception that a low pressure guide groove 20 is formed in the front head 11*a* instead of the drive shaft 4.

The like or corresponding parts are indicated by the same reference characters throughout several views and due to the structural similarity, a further description is not necessary.

According to a third embodiment shown in FIGS. 6 through 9, a sliding-vane rotary compressor includes a displacement-adjustment mechanism incorporated in a rear side block 7b and a rear head 11b. The compressor of this embodiment is the same as the compressor of the first-mentioned embodiment except the shape of the rear side block 7b and the internal construction of the rear side block 7b and the rear head 11b.

The displacement-adjustment mechanism is the same in principle as the mechanism as shown in Japanese Utility Model Laid-open Publication No. 55-2000. The mechanism includes a ring-shaped adjustment member 31 for adjusting the compression starting position. The adjustment member 31 is rotatably fitted in an annular groove 32 formed in one surface of the rear side block 7b facing the cylinder 1. The adjustment member 31 has a pair of diametrically opposite peripheral cut-out recesses 33a, 33b normally held in communication with a pair of intake holes 21a, 21b, respectively, formed in the rear side block 7b. With this arrangement, the circumferential position of the cut-out recesses 33a, 33b varies as the adjustment member 31 is turned so that it is possible to adjust the compression starting position, i.e. the position in which the vanes 6a–6e begins to block fluid communication between compression chambers 8a–8e and the intake holes 21a, 21b.

Figure 7:
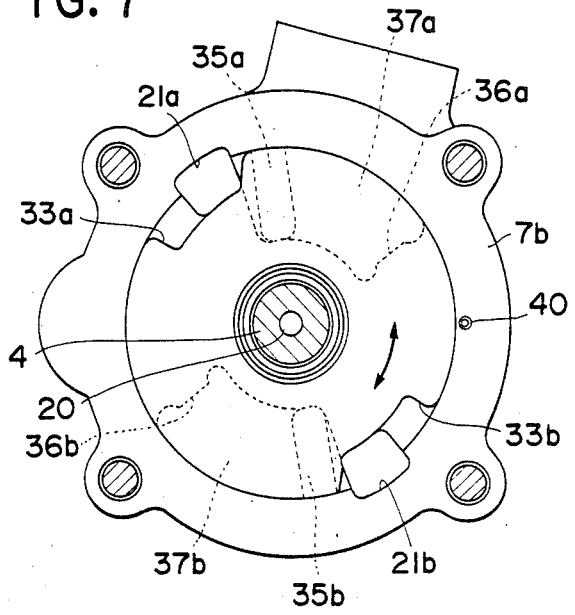
FIG. 7 is a cross-sectional view taken along line VII—VII of FIG. 6.
Figure 8:
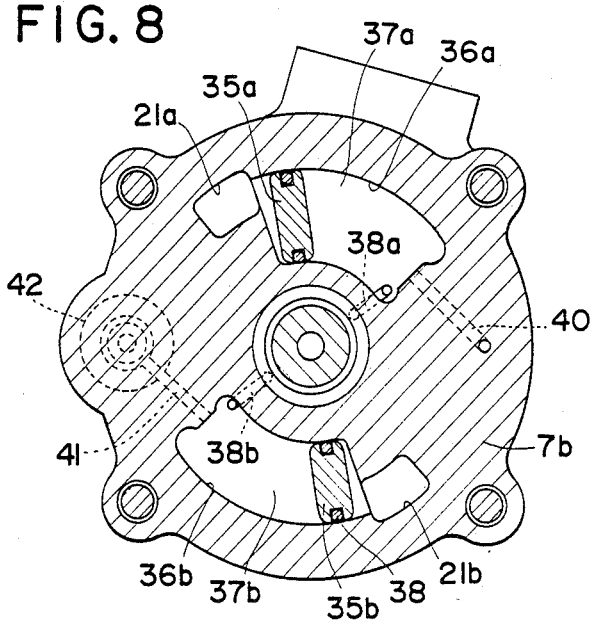
FIG. 8 is a cross-sectional view taken along line VIII—VIII of FIG. 6.
Figure 9:
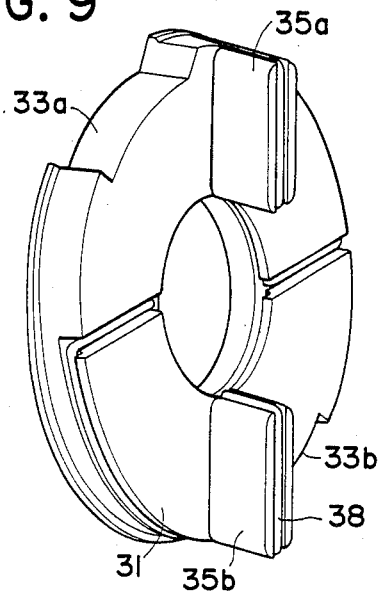
FIG. 9 is a perspective view of an adjustment member of the compressor shown in FIG. 6.
Figure 10:
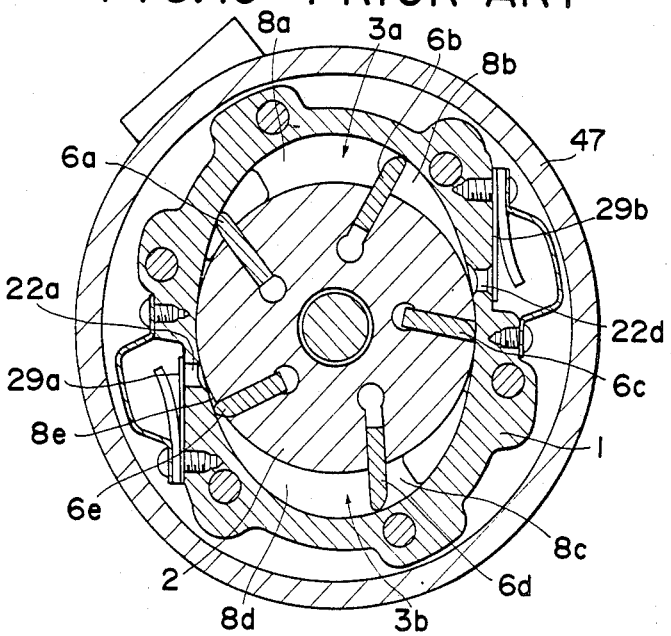
FIG. 10 PRIOR ART
FIG. 10 is a cross-sectional view of a conventional dual-compartment type sliding-vane rotary compressor.
Figure 11:
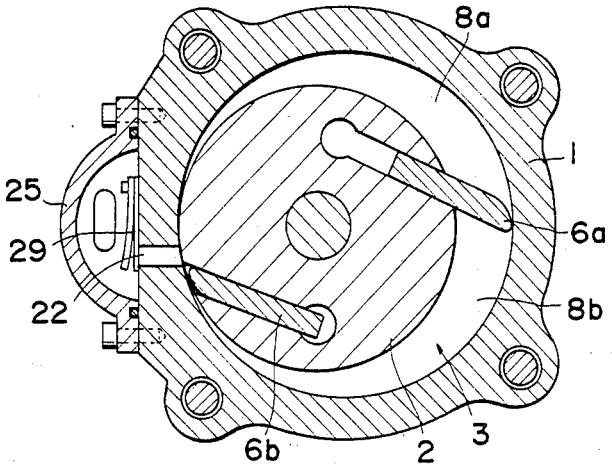
FIG. 11 PRIOR ART
FIG. 11 is a cross-sectional view of a conventional eccentric-rotor type sliding-vane rotary compressor.
Figure 12:
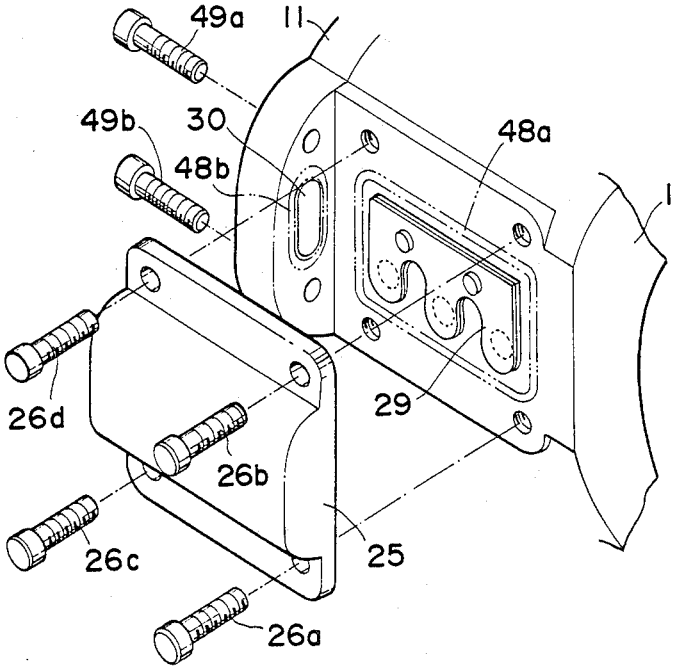
FIG. 12 PRIOR ART
FIG. 12 is an exploded perspective view showing a discharge valve and its related parts of the compressor shown in FIG. 11.

A torsion coil spring 34 constituting a resilient biasing or urging means is resiliently disposed and acting between the rear side block 7b and the adjustment member 31 for urging the latter to turn in the clockwise direction in FIGS. 7 and 8. The adjustment member 31 includes a pair of tongue-like pressure-retaining portions 35a, 35b projecting perpendicularly from the body of the adjustment member 31. The pressure-retaining portions 35a, 35b are slidably received in a pair of guide grooves 36a, 36b, respectively, formed in the rear side block 7b and extending contiguously from the intake holes 21a, 21b. Thus, there are two adjustment member pressure chambers 37a, 37b defined between the guide grooves 36a, 36b and the adjustment member 31. The adjustment member pressure chambers 37a, 37b are sealed from the outside by means of a seal member 38 which is fitted over the adjustment member 31. The pressure chambers 37a, 37b communicate with each other via a pair of connecting holes 38a, 38b extending through the rear side block 7b and also via a connecting space defined between the rear side block 7b and the rear head 11b. One of the pressure chambers 37a is held in fluid communication with a valve-receiving chamber 27a via an orifice 40 so that a metered flow of high pressure discharge gas is introduced into the pressure chambers 37a, 37b. The other pressure chamber 37b is connected with a low pressure chamber 17 through a connecting passage 41 formed in the rear side block 7b.

The connecting passage 41 is opened and closed by a control valve 42 disposed in the rear head 11b. The control valve 42 includes a bellows 43 capable of expanding and contracting in response to the pressure in the low pressure chamber 17, a ball valve element 44 connected to one end of the bellows 43, and a valve seat 45 against which the valve element 44 is seated. The control valve 42 thus constructed operates to vary the open area between the valve element 44 and the valve seat 45, thereby adjusting the rate of communication between the low pressure chamber 17 and the pressure chambers 37a, 37b.

The rear side block 7b has a radially extending low pressure connecting groove 46 through which the low pressure gas is introduced into a low pressure guide groove 20 in the drive shaft 4.

Operation of the displacement-adjustment mechanism is now described in detail. When the vehicle is cruising at low speed, the pressure in the low pressure chamber 17 is high. Under such condition, the bellows 43 of the control valve 42 is kept contracted to thereby move the valve element 44 in a direction to reduce the open area between the valve element 44 and the valve seat 45. Consequently, the amount of high pressure gas introduced through the orifice 40 into the pressure chambers 37a, 37b becomes greater than the amount of gas escaping from the pressure chambers 37a, 37b through the connecting passage 41 into the low pressure chamber 17. Thus the pressure in the pressure chambers 37a, 37b is increased. With this pressure rise, the adjustment member 31 is caused to turn counterclockwise against the bias of the spring 34, thereby displacing the compression starting position in the counterclockwise direction. As a result, the compression starting timing is advanced, thereby increasing the amount of gas to be trapped in the compression chambers 8a–8e. The compressor is thus driven at a large displacement.

When the vehicle is cruising at high speed, the pressure in the low pressure chamber 17 is low. Consequently, the bellows 43 of the control valve 42 is caused to expand to thereby move the valve element 44 in a direction to increase the open area between the valve element 44 and the valve seat 45. Under such condition, the amount of gas escaping from the pressure chambers 37a, 37b is increased and the pressure in the pressure chambers 37a, 37b is reduced. With this pressure drop, the adjustment member 31 is caused to turn clockwise under the force of the spring 34, thereby displacing the compression starting position in the clockwise direction. As a result, the timing when the cut-out recesses 33a, 33b are closed by the succeeding vanes 6a–6e is retarded. With this delaying, gas in the compression chambers 8a–8e flows back into the low pressure chamber 17, thereby reducing the amount of gas to be compressed in the compression chambers 8a–8e. The compressor is thus driven at a reduced displacement.

In the first and third embodiments, the like or corresponding parts are indicated by the like or corresponding reference characters throughout several views.

Obviously, many modifications and variations of the present invention are possible in the light of the above teaching. It is therefore to be understood that within the scope of the appended claims, the invention may be practiced otherwise than as specifically described.

What is claimed is:

1. A sliding-vane rotary compressor comprising:

(a) a cylinder and a rotor rotatably disposed in said cylinder for defining therebetween an operating compartment, said rotor carrying thereon a plurality of substantially radially movable sliding vanes, there being defined between said cylinder, said rotor and said vanes a plurality of compression chambers which vary in volume with each revolution of said rotor;

(b) a pair of side blocks secured to opposite ends of said cylinder;

(c) a pair of heads secured to said side blocks, respectively, on opposite sides of said cylinder;

(d) a first one of said pair of side blocks and a first one of said pair of heads secured to said first side block jointly defining therebetween a low pressure chamber in fluid communication with an intake port of said compressor;

(e) the second one of said pair of side blocks and the second one of said pair of heads jointly defining therebetween a high pressure chamber in fluid communication with a discharge port of said compressor;

(f) said first side block having an intake hole connecting said low pressure chamber and said operating compartment;

(g) said cylinder having a recess defined in an outer surface thereof, and a discharge hole having first and second ends, said first end opening to said operating compartment and said second end opening to said recess for fluidly communicating said operating compartment and said recess;

(h) a cover secured to said cylinder and extending over said recess for closing said recess, there being defined between said cylinder and said cover a valve receiving chamber;

(i) a tubular discharge valve disposed in said valve receiving chamber for opening and closing said discharge hole, said tubular discharge valve having a longitudinal slit therein;

(j) a stopper projection on said cover and extending toward said cylinder, and said stopper projection extending into said longitudinal slit of said stopper projection extending into said longitudinal slit of said tubular discharge valve for limiting movement of said discharge valve away from said discharge hole for limiting the opening of said discharge hole;

(k) said cylinder and said second side block having a discharge connecting hole extending between said recess and said high pressure chamber; and (l) a displacement-adjustment mechanism incorporated in said first side block and said first head for adjusting displacement of said compressor, said displacement-adjustment mechanism including:

(i) an adjustment member rotatably disposed in said first side block for adjusting a compression starting position;

(ii) resilient means for urging said adjustment member to turn in one direction;

(iii) an adjustment member pressure chamber means for producing a pressure acting on said adjustment member for urging the latter to turn in the opposite direction against the force of said resilient means, and said adjustment member pressure chamber means being fluidly connected with said high pressure chamber; and (iv) a control valve for adjusting the rate of fluid communication between said adjustment member pressure chamber means and said low pressure chamber according to the pressure in said low pressure chamber.

2. A device as in claim 1, wherein said discharge valve is resilient, said longitudinal slit extends the entire length of said discharge valve and defines a pair of free longitudinal edges thereof, said free longitudinal edges resiliently engage said stopper projection, and said resilient discharge valve keeps said discharge hole normally closed.

* * * * *

UNITED STATES PATENT AND TRADEMARK OFFICE

CERTIFICATE OF CORRECTION

PATENT NO. : 4,801,251

DATED : January 31, 1989

INVENTOR(S) : Nobuyuki NAKAJIMA et al.

It is certified that error appears in the above—identified patent and that said Letters Patent is hereby corrected as shown below:

Column 9, (Claim 1), under "(j)", lines 3 and 4 thereof, delete "extending into said longitudinal slit of said stopper projection".

Signed and Sealed this

Fifth Day of September, 1989

*Attest:*

*Attesting Officer*

DONALD J. QUIGG

*Commissioner of Patents and Trademarks*